US006237837B1

(12) United States Patent
Martin

(10) Patent No.: US 6,237,837 B1
(45) Date of Patent: May 29, 2001

(54) PLANAR BLANK FOR AN ENVELOPE AND AN ENVELOPE MADE THEREFROM

(75) Inventor: John J. Martin, Louisville, KY (US)

(73) Assignee: Crane Productions, Inc., Louisville, KY (US)

( * ) Notice: Subject to any disclaimer, the term of this patent is extended or adjusted under 35 U.S.C. 154(b) by 0 days.

(21) Appl. No.: 09/395,144

(22) Filed: Sep. 14, 1999

(51) Int. Cl.[7] ..... B65D 27/04

(52) U.S. Cl. ..... 229/71; 229/75; 229/307; 40/124.06; 40/124.17

(58) Field of Search ..... 229/71, 307, 313, 229/316, 309, 310, 311, 75; 40/124.06, 124.17, 124.18

(56) References Cited

U.S. PATENT DOCUMENTS 1,801,155 * 4/1931 Harson ..... 229/92.7
2,346,419 * 4/1944 Dunlop ..... 229/75
3,408,908 * 11/1968 Berkowitz ..... 229/71
5,251,810 * 10/1993 Kim ..... 229/71
5,458,282 * 10/1995 Martin ..... 229/92.8
5,641,116 * 6/1997 Martin ..... 229/92.8
5,788,144 * 8/1998 Sorge et al. ..... 229/71
5,904,290 * 5/1999 Lin ..... 229/309
5,961,436 * 10/1999 Ding ..... 229/311
5,984,170 * 11/1999 Scheuren ..... 229/311
6,024,278 * 2/2000 Martin ..... 229/92.8

* cited by examiner

*Primary Examiner*—Stephen P. Garbe
(74) *Attorney, Agent, or Firm*—James C. Eaves, Jr.; Greenebaum Doll & McDonald PLLC

(57) ABSTRACT

The present invention relates to a planar blank for an envelope and an envelope made therefrom. An insert is placed into the envelope at an insertion end and removed by the consumer at an opposed removal end. The removal end is easy to open, as the consumer only has to break a plurality of ties between the envelope front and back. Preferably the envelope back contains a magnet so that the envelope can be removably attached to a metal surface, such as a refrigerator. When the envelope is attached to a metallic object using the magnet, a window in the envelope front is visible, permitting the item mailed, or a photograph or other item to be displayed as if in a picture frame. A window can be included in the envelope back to prevent blind matches of labels to envelopes containing personalized mail, as the address/postage can be part of the insert viewable through this window. Further, one or more legs can be cut into the blank which can be folded out to permit the envelope to stand by itself.

25 Claims, 11 Drawing Sheets

PLANAR BLANK FOR AN ENVELOPE AND AN ENVELOPE MADE THEREFROM

BACKGROUND OF THE INVENTION (a) Field of the Invention

The present invention relates to a planar blank for an envelope and an envelope made therefrom. An insert is placed into the envelope at an insertion end and removed by the consumer at an opposed removal end. The removal end is easy to open, as the consumer only has to break a plurality of ties between the envelope front and back. Preferably the envelope back contains a magnet so that the envelope can be removably attached to a metal surface, such as a refrigerator. When the envelope is attached to a metallic object using the magnet, a window in the envelope front is visible, permitting the item mailed, or a photograph or other item to be displayed as if in a picture frame. A window can be included in the envelope back to prevent blind matches of labels to envelopes containing personalized mail, as the address/postage can be part of the insert viewable through this window. Further, one or more legs can be cut into the blank which can be folded out to permit the envelope to stand by itself.

(b) Description of the Prior Art

Applicant is aware of no prior art where an insert is placed into one envelope opening by the sender and the recipient breaks at least one tie at an envelope opening opposed to the insertion opening to permit removal of the insert.

SUMMARY OF THE INVENTION

The present invention relates to a planar blank for an envelope and an envelope made therefrom. In the preferred embodiment, the planar blank contains a pair of ties connecting the envelope front and back. Other than the two ties, the fold line along which the front and back are folded is slit open. The envelope's opposite end is a traditional envelope design into which an insert can be inserted and a flap folded over and glued by a sender. The recipient does not disturb the insertion end, but rather breaks the two ties at the opposite end to remove the insert. The envelope back contains the mailing address information and postage and, preferably, a magnetic strip. This magnetic strip permits the back of the envelope to be magnetically affixed to a metal surface, such as a refrigerator door. The front of the envelope preferably contains a window therein, the window having a transparent film thereacross. When the envelope is attached to a metallic object using the magnet, the front window is visible, permitting the item mailed, or a photograph or other item to be displayed as if in a picture frame. Further, a window can be included in the envelope back to prevent blind matches for personalized mail, as the address/postage can be part of the insert viewable through this window. Additionally, one or more legs can be cut into the blank which can be folded out to permit the envelope to stand by itself like a picture frame.

More particularly, the preferred embodiment of the present invention comprises a windowed envelope for magnetic attachment to a metallic surface, including: a front, having a top, a bottom, a first frontside and a second frontside; a back, having a top, a bottom, a first backside and a second backside; a bottom flap adjoining the bottom of the front; a first side flap adjoining the first frontside; a second side flap adjoining the second frontside; a window located on the front; a film affixed to the front over the window; a slot located at the top of the back; a magnet affixed to the back; a strip of remoistenable adhesive located on the bottom flap; the top of the front being connected to the top of the back by at least two ties; the first side flap being folded over the first frontside along a first fold line; the second side flap being folded over the second frontside along a second fold line; the back being folded toward the front along a third fold line; the at least two ties lying along the third fold line; the at least two ties having a first cut therebetween; the at least two ties being located a distance away from the first and second frontsides and the first and second backsides, and a second and a third cut extending outwardly from the at least two ties; a fourth cut located along a part of the first fold line between the first side flap and the first frontside; a fifth cut located along a part of the second fold line between the second side flap and the second frontside; the first side flap being affixed to the first backside; the second side flap being affixed to the second backside; an insert placed in a cavity created between the front and the back by folding the back toward the front along the third fold line; the bottom flap being folded over the bottom of the back along a fourth fold line; and the bottom flap being affixed to the bottom of the back.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

Figure 1:
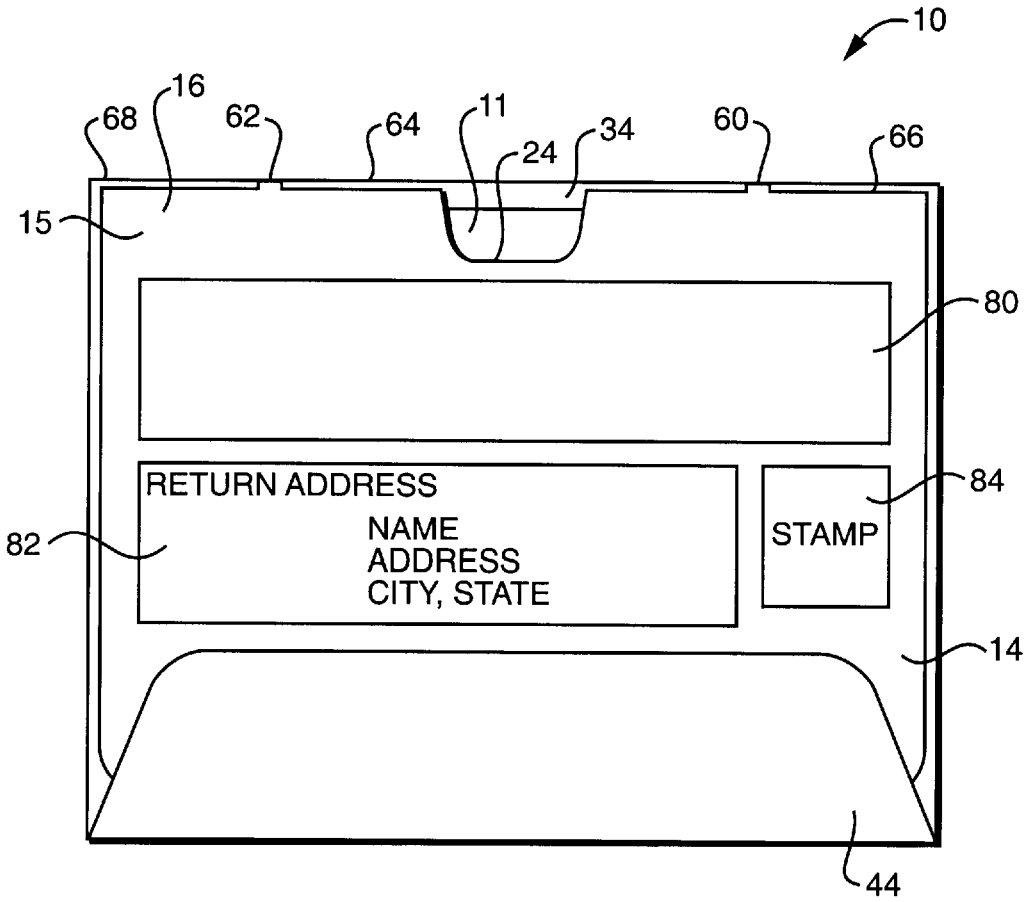
FIG. 1 is a back view of the envelope of the preferred embodiment as it would be placed in the mail.
Figure 2:
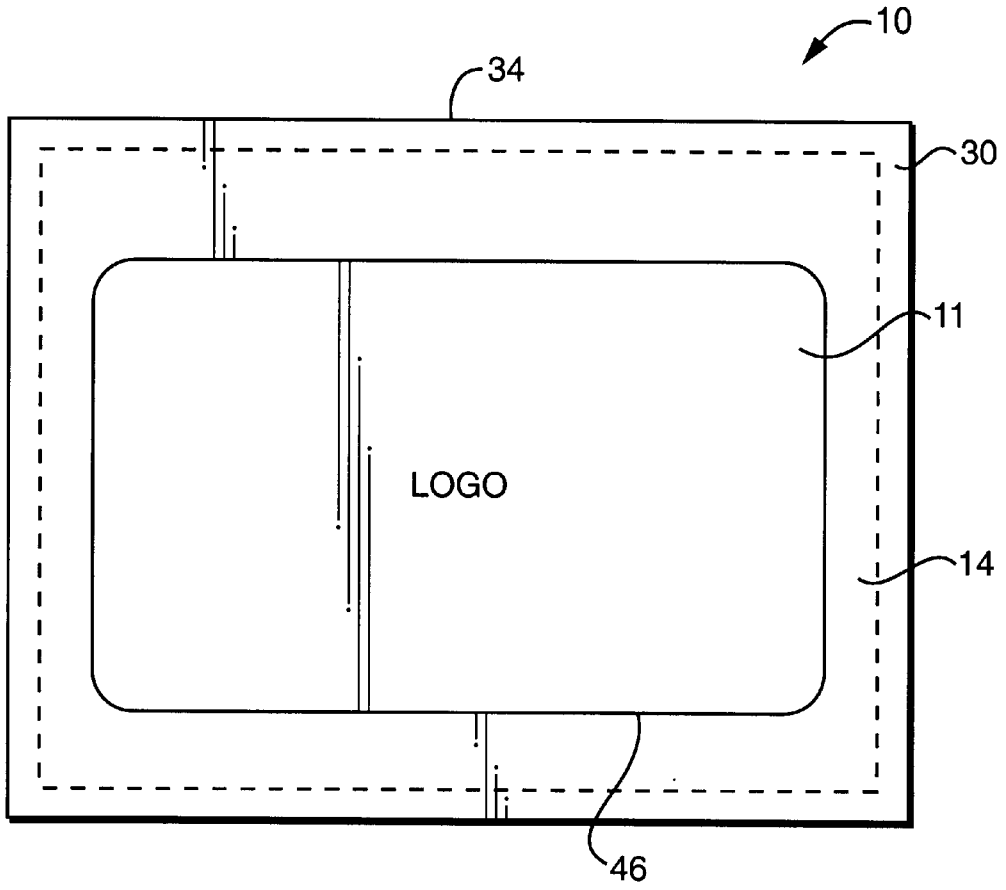
FIG. 2 is a front view of the envelope of FIG. 1.

With reference to the Figures, FIG. 1 shows the back 15 of an envelope 10 made from a planar blank 12. FIG. 2 shows the front 30 of envelope 10. This envelope 10 is an "easy to open" envelope. A consumer can hold the edge of insert 11 and the top 34 of front 30 at slot 24. Then grasping back 15 at slot 24, the consumer pulls the top 34 of front 30 and top 16 of back 15 apart, thereby breaking ties 60 and 62. This permits removal of the insert 11.

As seen in FIG. 1, the envelope 10 has a magnetic strip 80 toward the top 16 of back 15. An address label 82 and postage 84 have been applied to back 15 between the magnetic strip 80 and bottom flap 44. Alternatively, address and postage information can be printed directly onto envelope 10, or can be included with insert 11 as explained with the description of FIGS. 9–11. It is envisioned that with this configuration, envelope 10 will be handled as automated letter mail and entitled to letter automation discount rates for mailing with the USPS.

Magnet 80 is preferably a known thin sheet of flexible magnetic material, such as a vinyl material having magnetic materials dispersed therethrough. Such a sheet of flexible magnetic materials can be obtained under the trademark "UltraMag" from Flex-Mag Industrial, Inc., of Marietta, Ohio. In the preferred embodiment, the envelope 10 is approximately 4⅜ inches (11.1 cm) high and 5⅝ inches (14.3 cm) wide. Magnetic strip 80 is preferably 1 inch (2.5 cm) high and 5 inches (12.7 cm) wide. However, depending on the magnetic capabilities of the magnetic material and the weight of the item to be magnetically affixed, magnet size can be varied. Also, a plurality of magnetic strips could be used, for example, magnetic strips could be placed in corners of the envelope.

FIG. 2 shows the front 30 of the envelope 10. The dashed lines show the insert 11 contained inside envelope 10. Envelope 10 contains a window opening 46. Anything written on the exposed side of insert 11, such as a logo, photograph, drawing, etc. will be visible through window 46. With the magnetic strip 80, the back 15 side of envelope 10 can be placed onto a metallic surface, such as a refrigerator, and held there by magnet 80. That leaves the front 30 as seen in FIG. 2 viewable. Therefore, envelope 10 can be reused by the consumer as a frame to show off photos or items of interest, or as an envelope to hold things. If the envelope 10 does not contain a window 46, the front 30 can be printed as desired.

Figure 3:
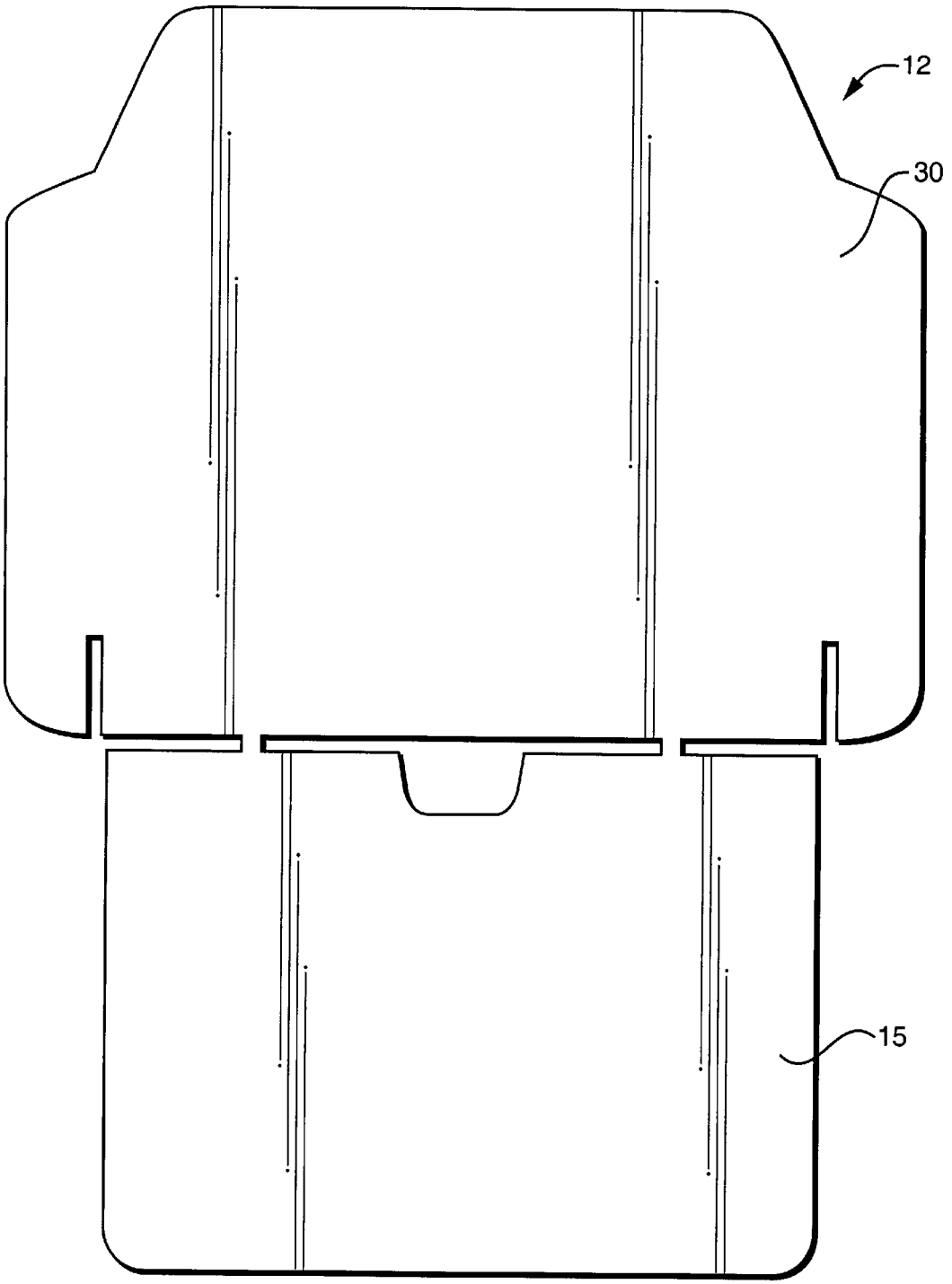
FIG. 3 is a plan view of a planar blank which can be used to make a non-windowed envelope of the present invention.
Figure 4:
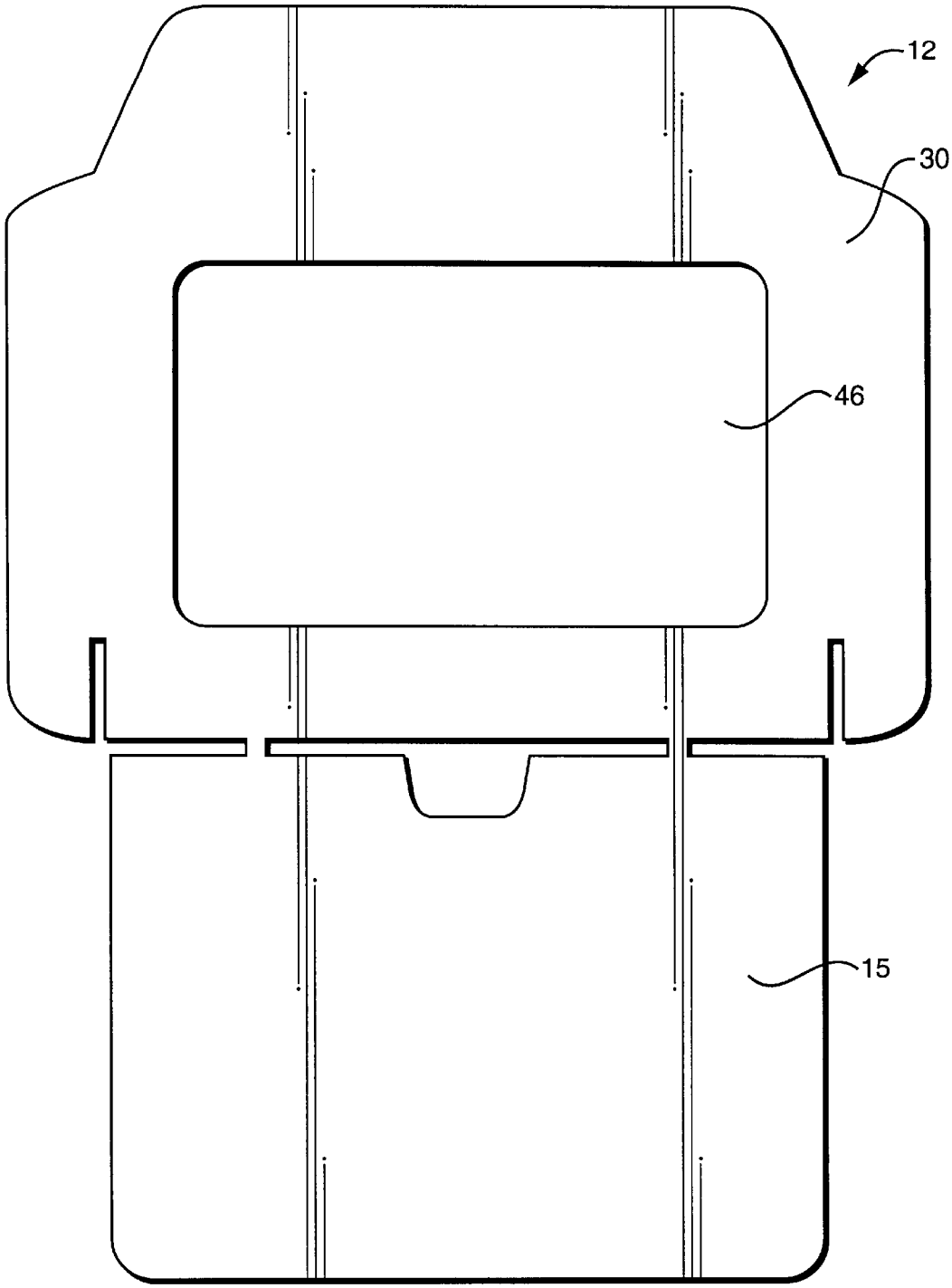
FIG. 4 is a plan view of a planar blank which can be used to make a windowed envelope of the present invention.

FIGS. 3–8 show the planar blank 12 used to make the envelope 10 and the process of making the envelope 10. The planar blanks 12 of FIGS. 3 and 4 are identical except the blank 12 of FIG. 4 has a window 46 therethrough. It is envisioned that planar blank 12 will be 8 point card stock, although lighter or heavier card stock can be used.

Figure 5:
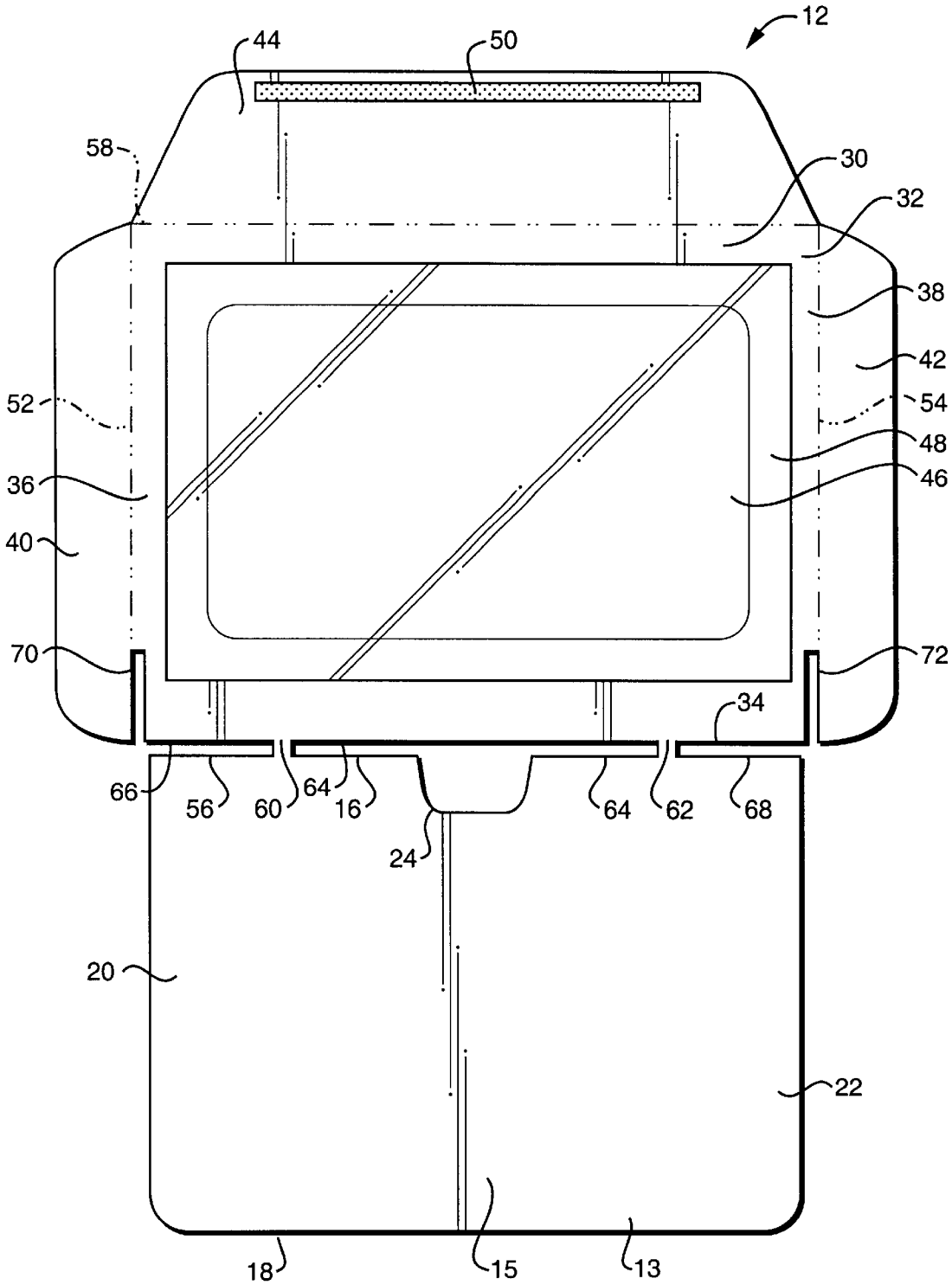
FIG. 5 is a view of the planar blank for making a windowed envelope of FIG. 4 prior to folding, the blank having a film attached over the window and an adhesive strip attached to the bottom flap.

Planar blank 12 is unitary and has all of the cuts shown in FIGS. 3 and 4 made simultaneously. The blank 12 of FIG. 5 is used to explain the cuts and the envelope manufacturing process. FIGS. 3–5 show the envelope 10 inside surfaces 13, as contrasted to FIGS. 1 and 2 which show the envelope 10 opposed outside surfaces 14. Blank 12 of FIG. 5 contains a back 15 having a top 16, a bottom 18, a first backside 20, and a second backside 22. A slot 24 is cut out at the center of top 16. Front 30 has a bottom 32, a top 34, a first frontside 36, and a second frontside 38. A first side flap 40 adjoins or is connected to first frontside 36, with a first fold line 52 therebetween. A second side flap 42 adjoins or is connected to second frontside 38, with a second fold line 54 therebetween. A bottom flap 44 adjoins or is connected to bottom 32, with a fourth fold line 58 therebetween. A remoistenable adhesive strip 50 has been applied on the inside surface side 13 of bottom flap 44. It is through this bottom flap 44 that the sender will insert an insert(s) 11, remotes the adhesive strip 50, seal flap 44, and address the envelope for mailing. Blank 12 of FIG. 5 shows the optional window 46 of the preferred embodiment. A thin, transparent film 48 has been placed over the window 48 and attached to the inside surface 13 of front 30.

The front 30 and back 15 of blank 12 are connected by a plurality of ties 60, 62 at their respective tops 34, 16. Two ties are shown, although one or more can be employed. Ties 60, 62 are spaced from slot 24 about midway from slot 24 to first backside 20 and second backside 22, respectively. A first cut 64 is between ties 60, 62. A second cut 66 is from tie 60 and first backside 20 and a third cut 68 is from tie 62 and second backside 22. Ties 60, 62 and cuts 64, 66, and 68 are aligned along a third fold line 56. At the top 34 end of front 30, along first fold line 52, a relatively short fourth cut 70 is made from the top 34 toward the bottom 32. Likewise, at the top 34 end of front 30, along second fold line 54, a relatively short fifth cut 72 is made from the top 34 toward the bottom 32. Preferably cuts 70 and 72 are substantially perpendicular to cuts 64, 66, and 68.

Figure 6:
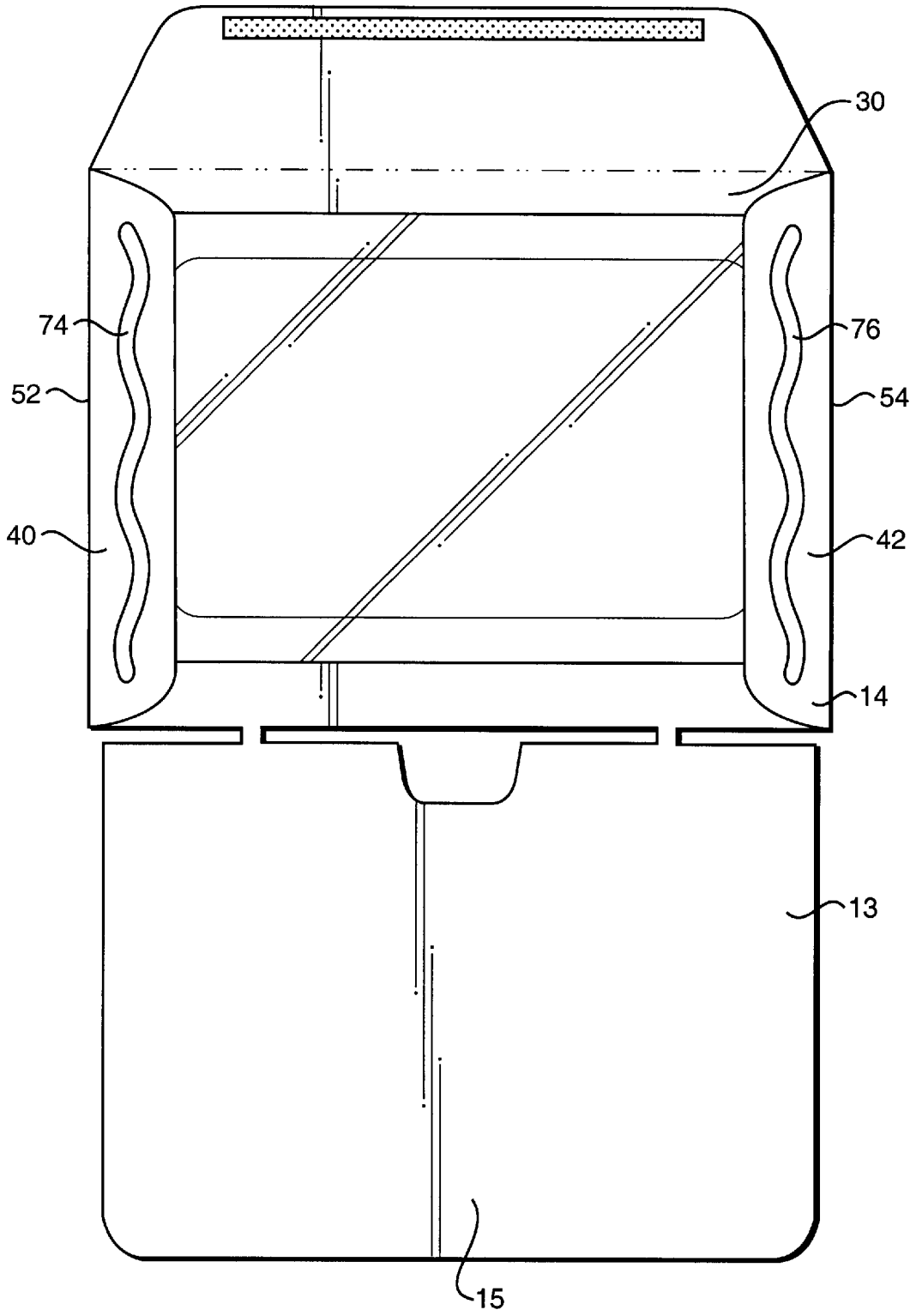
FIG. 6 is a plan view of the planar blank of FIG. 5, showing the side flaps being folded and the application of an adhesive.

With reference to FIG. 6, first side flap 40 has been folded over along said first fold line 52 to engage the inside surface 13 of front 30. Likewise, second side flap 42 has been folded over along said second fold line 54 to engage the inside surface 13 of front 30. Adhesive 74, 76 is applied to outer surface 14 of side flaps 40, 42 respectively.

Figure 7:
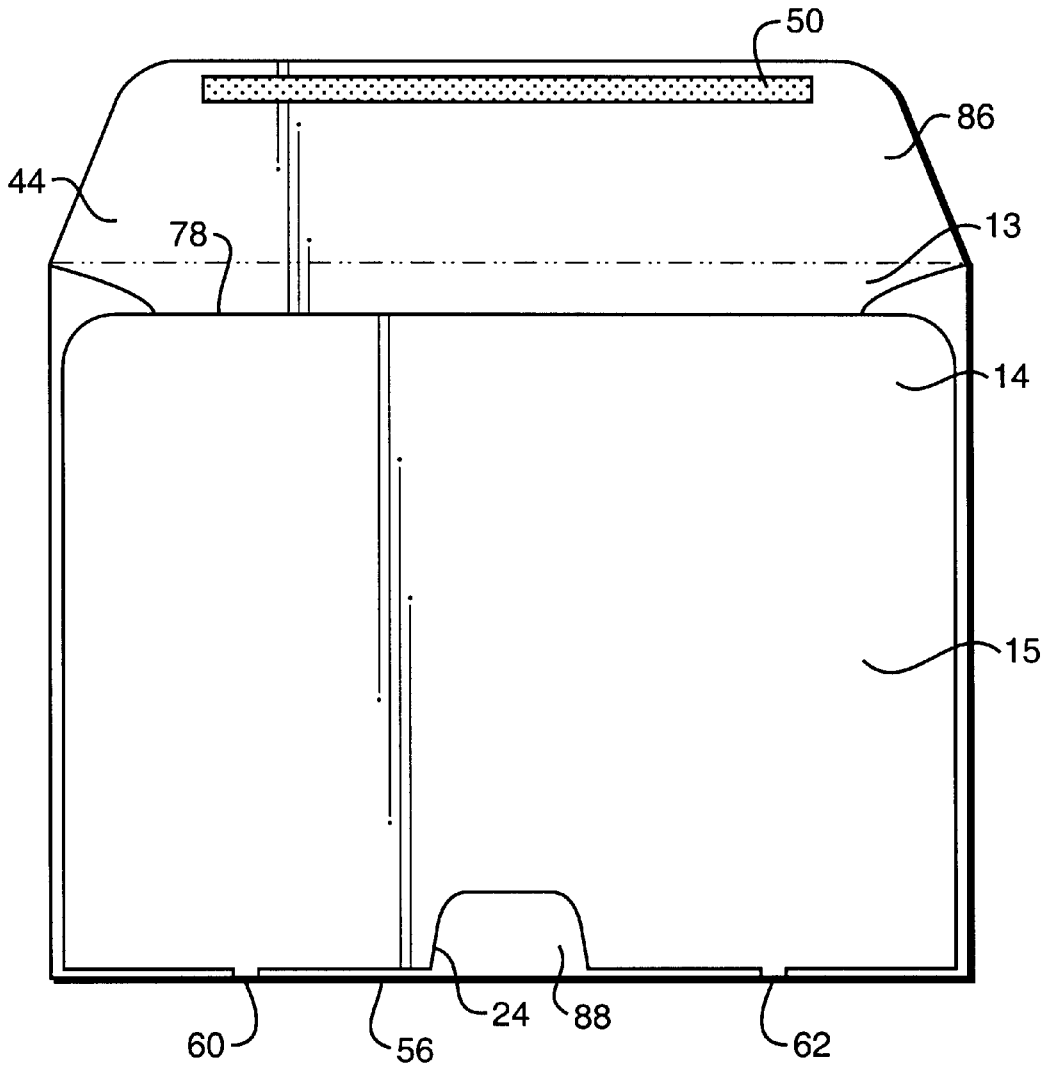
FIG. 7 is a plan view of the planar blank of FIG. 6, the envelope back having been folded to form the envelope ready to receive an insert.

With reference to FIG. 7, back 15 has been folded over along said third fold line 56 and connected by adhesive 74, 76 to form envelope 10 and create a cavity 78 for receipt of an insert. Magnetic strip 80 can be applied at this time or after an insert is placed into the envelope 10, as desired. Alternatively, the envelope can be used without a magnetic strip 80. As shown in FIG. 7, envelope 10 is ready to receive an insert through insertion opening 86. Opposed to opening 86 is removal end 88 through which the recipient will remove the insert contained in the envelope 10.

Figure 8:
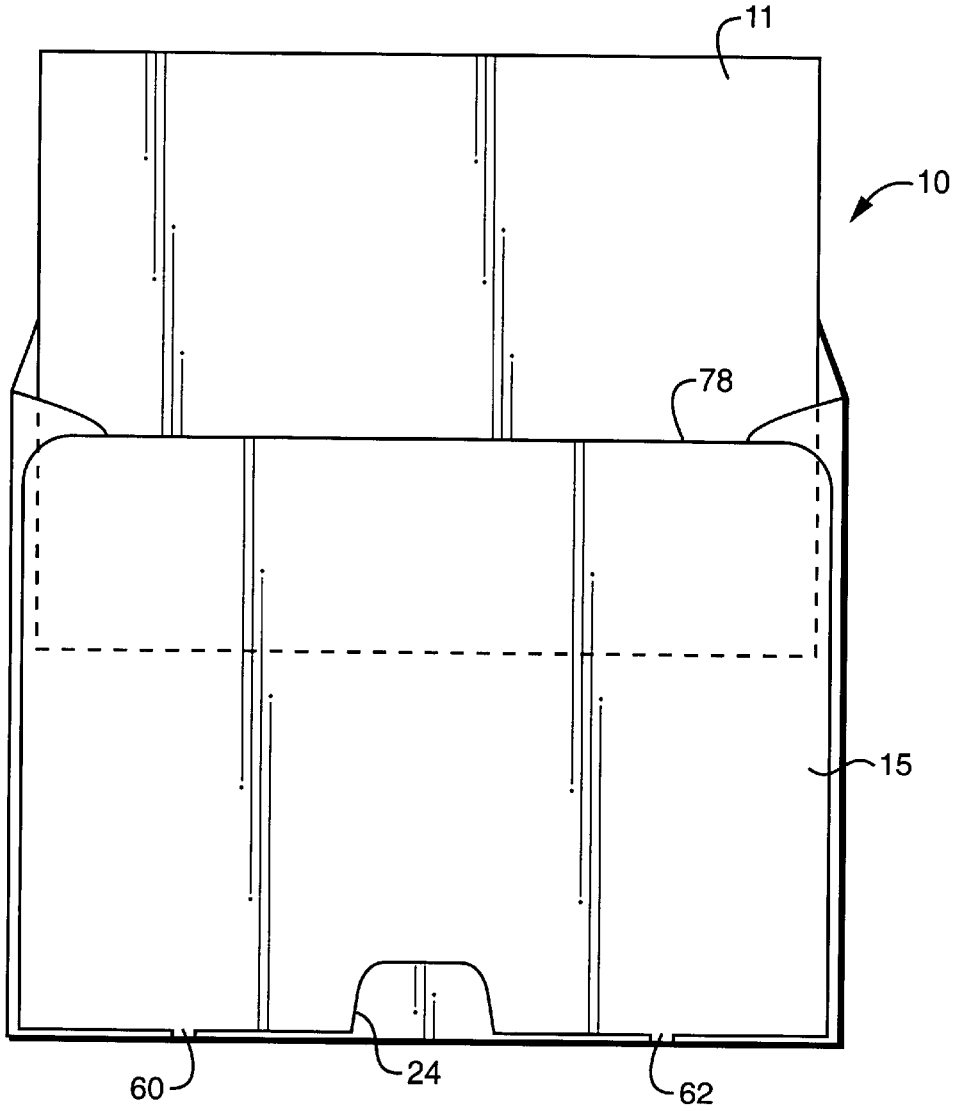
FIG. 8 is a plan view of the envelope of FIG. 7 showing the insertion of an insert.

The insertion of an insert 11 into cavity 78 of envelope 10 is shown in FIG. 8. When the insert 11 is placed fully within the envelope 10, remoistenable adhesive strip 50 is moistened, bottom flap 44 is folded along fourth fold line 58 and sealed against the outer surface 14 of back 15. With the addition of the magnet 80, the address label 82, and postage 84, the mailable envelope having an insert therein of FIGS. 1 and 2 has been created. This is the preferred embodiment.

Figure 9:
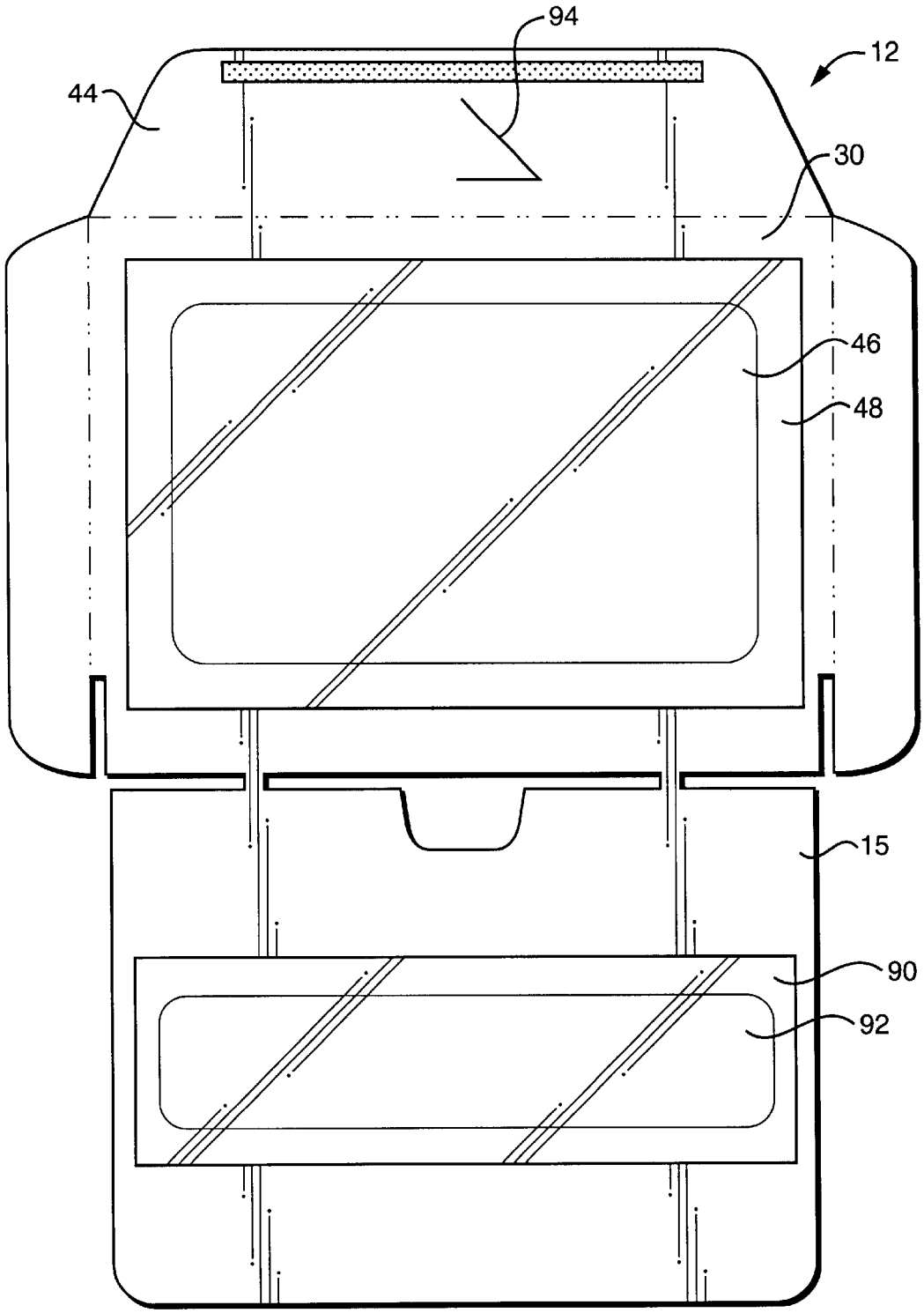
FIG. 9 is a view of a planar blank for making a double windowed envelope prior to folding, the blank having a window in the envelope front and the envelope back, the blank having a film attached over the windows, an adhesive strip attached to the bottom flap, and a die cut leg in the bottom flap.
Figure 10:
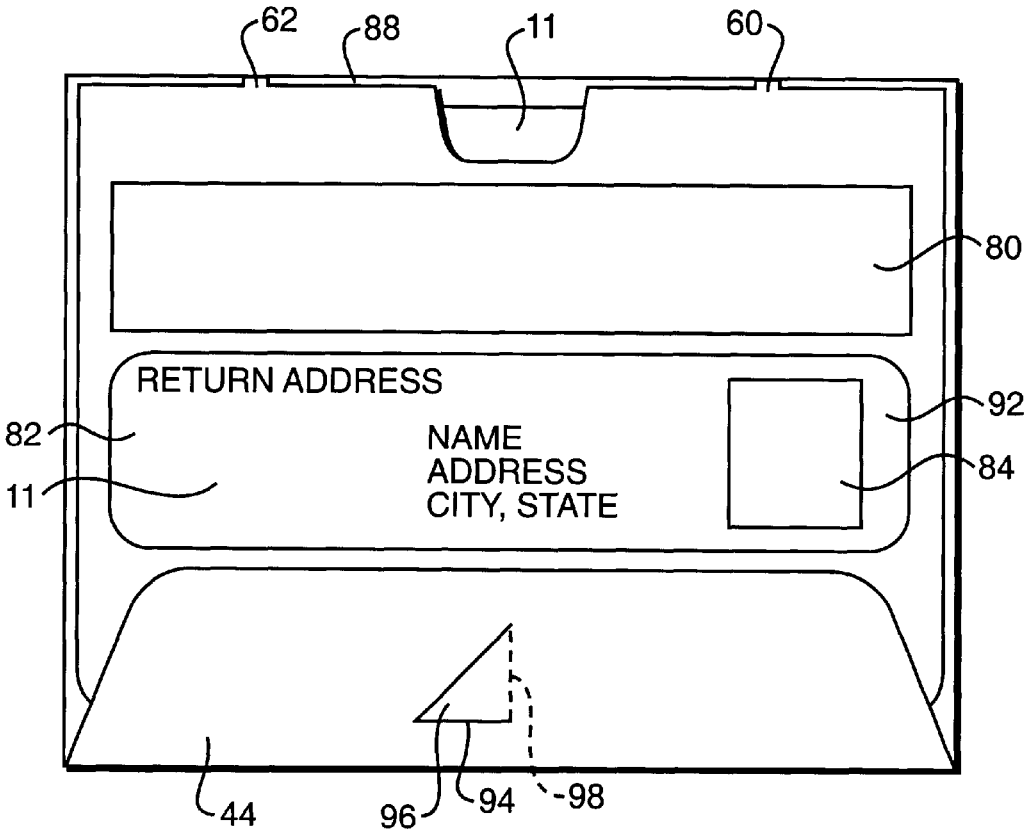
FIG. 10 is a back view of the envelope made from the blank of FIG. 9 as it would be placed in the mail, the envelope having a magnetic strip thereon; and, FIG. 11 is a back view of an envelope having an address window as it would be placed in the mail, the envelope having a pair of legs for supporting the envelope in a standing configuration, the envelope not having a magnetic strip thereon.
Figure 11:
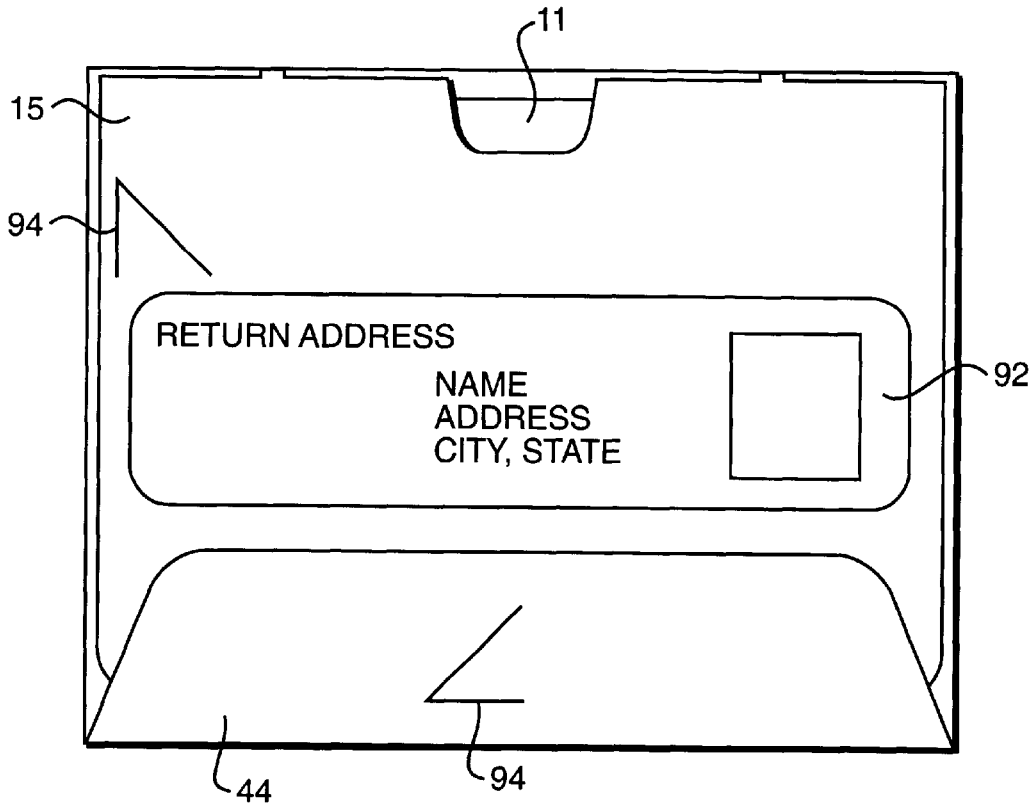

FIG. 9 shows a planar blank 12, similar to the blank of FIG. 5, with the addition of a window 92 in the back 15, the window 92 preferably having a transparent film 90 thereover as with window 46 and film 48. Bottom flap 44 is shown having a "sail-shaped" die cut therein which forms a leg 94. As seen in FIG. 10, leg 94 is on the address side of the envelope 10 distant from the removal end 88, where the ties 60, 62 are severed to remove insert 11 from envelope 10. The tip 96 of leg 94 can be pulled outward from envelope 10 bending leg 94 outward along fold line 98. With leg 94 extending approximately transverse to bottom flap 44, leg 94 will support the envelope 10 so that it can be self-standing. Leg or legs 94 can be used with an envelope 10 having a magnetic strip 80, as shown in FIG. 10. Also, leg or legs 94 can be employed with an envelope 10 not having a magnetic strip 80, as shown in FIG. 11. Instead of one leg 94, a pair of legs could be located at opposite sides of bottom flap 44. Similar legs could be placed on the "long" and "short" side of envelope 10 as shown by the pair of legs 94 in FIG. 11, one leg 94 being on bottom flap 44 and one leg 94 being on back 15. This permits the envelope 10 to stand such that any picture or image within the envelope is properly oriented for viewing through window 46. It is noted that with leg 94 on back 15, the adhesive line 76 of FIG. 6 would need adjustment so that this leg 94 is not adhesively attached to second side flap 42.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A windowed envelope for magnetic attachment to a metallic surface, comprising: a front, having a top, a bottom, a first frontside and a second frontside; a back, having a top, a bottom, a first backside and a second backside; a bottom flap adjoining said bottom of said front; a first side flap adjoining said first frontside; a second side flap adjoining said second frontside; a window located on said front; a film affixed to said front over said window; a slot located at said top of said back; a magnet affixed to said back; a strip of remoistenable adhesive located on said bottom flap; said top of said front being connected to said top of said back by at least two ties; said first side flap being folded over said first frontside along a first fold line; said second side flap being folded over said second frontside along a second fold line; said back being folded toward said front along a third fold line; said at least two ties lying along said third fold line; said at least two ties having a first cut there between; said at least two ties being located a distance away from said first and second frontsides and said first and second backsides, and a second and a third cut extending outwardly from said at least two ties; a fourth cut located along a part of said first fold line between said first side flap and said first frontside; a fifth cut located along a part of said second fold line between said second side flap and said second frontside; said first side flap being affixed to said first backside; said second side flap being affixed to said second backside; an insert placed in a cavity created between said front and said back by folding said back toward said front along said third fold line; said bottom flap being folded over said bottom of said back along a fourth fold line; and said bottom flap being affixed to said bottom of said back.

2. An envelope, comprising: a front, having a top, a bottom, a first frontside and a second frontside; a back, having a top, a bottom, a first backside and a second backside; a bottom flap adjoining said bottom of said front; a first side flap adjoining said first frontside; a second side flap adjoining said second frontside; said top of said front being connected to said top of said back by at least two ties; said first side flap being folded over said first frontside along a first fold line; said second side flap being folded over said second frontside along a second fold line; said back being folded toward said front along a third fold line; said at least two ties lying along said third fold line; said at least two ties having a first cut there between; said first side flap being affixed to said first backside; said second side flap being affixed to said second backside; and where a slot is located at said top of said back.

3. The envelope as recited in claim 2, where a magnet is affixed to said back.

4. The envelope as recited in claim 2, where said at least two ties are located a distance away from said first and second frontsides and said first and second backsides, and a second and a third cut extend outwardly from said at least two ties.

5. The envelope as recited in claim 4, where a fourth cut is located along a part of said first fold line between said first side flap and said first frontside and a fifth cut is located along a part of said second fold line between said second side flap and said second frontside.

6. The envelope as recited in claim 2, where said front contains a window.

7. The envelope as recited in claim 6, where a film is affixed to said front over said window.

8. The envelope as recited in claim 2, where a strip of remoistenable adhesive is located on said bottom flap.

9. The envelope as recited in claim 3, where said front contains a window.

10. A planar blank for forming an envelope, comprising: a front, having a top, a bottom, a first frontside and a second frontside; a back, having a top, a bottom, a first backside and a second backside; a bottom flap adjoining said bottom of said front; a first side flap adjoining said first frontside; a second side flap adjoining said second frontside; said top of said front being connected to said top of said back by at least two ties; said at least two ties having a first cut there between; and where a slot is located at said top of said back.

11. The planar blank as recited in claim 10, where said at least two ties are located a distance away from said first and second frontsides and said first and second backsides, and a second and third cut extend outwardly from said at least two ties.

12. The planar blank as recited in claim 11, where a fourth cut is located between said first side flap and said first frontside and a fifth cut is located between said second side flap and said second frontside.

13. The planar blank as recited in claim 11, where said front contains a window.

14. The planar blank as recited in claim 13 where a film is affixed to said front over said window.

15. The planar blank as recited in claim 10, where a strip of remoistenable adhesive is located on said bottom flap.

16. The planar blank as recited in claim 11, where said front contains a window.

17. The planar blank as recited in claim 16 where a film is affixed to said front over said window.

18. The planar blank as recited in claim 17, where a slot is located at said top of said back.

19. The envelope as recited in claim 2, where said back contains a window.

20. The envelope as recited in claim 3, where said back contains a window.

21. The envelope as recited in claim 6, where said back contains a window.

22. The envelope as recited in claim 2, where said envelope includes at least one leg.

23. The planar blank as recited in claim 10, where said back contains a window.

24. The planar blank as recited in claim 13, where said back contains a window.

25. The planar blank as recited in claim 10, where said planar blank includes at least one leg.

* * * * *

UNITED STATES PATENT AND TRADEMARK OFFICE

CERTIFICATE OF CORRECTION

PATENT NO. : 6,237,837 B1
DATED : May 29, 2001
INVENTOR(S) : John J. Martin

It is certified that error appears in the above-identified patent and that said Letters Patent is hereby corrected as shown below:

Column 4,
Line 1, delete “remotes” and insert instead -- remoisten --

Column 6,
Line 36, delete “in claim 11” and insert instead -- in claim 10 --

Signed and Sealed this

Twenty-fourth Day of September, 2002

*Attest:*

*Attesting Officer*

JAMES E. ROGAN
*Director of the United States Patent and Trademark Office*